United States Patent [19]

Uchimura et al.

[11] Patent Number: 5,044,801

[45] Date of Patent: Sep. 3, 1991

[54] PRINTING APPARATUS

[75] Inventors: Mitsuo Uchimura, Numazu; Seiji Koike, Shizuoka; Takeshi Tashiro, Mishima; Toshiharu Shimosato, Shizuoka; Kazuhiro Fushimi, Mishima; Osamu Koizumi, Shizuoka, all of Japan

[73] Assignee: Tokyo Electric Co., Ltd., Tokyo, Japan

[21] Appl. No.: 448,749

[22] Filed: Dec. 11, 1989

[30] Foreign Application Priority Data

Dec. 15, 1988 [JP] Japan ..... 63-162674[U]
Dec. 15, 1988 [JP] Japan ..... 63-162675[U]

[51] Int. Cl.[5] ..... B41J 29/02
[52] U.S. Cl. ..... 400/692; 400/693
[58] Field of Search ..... 101/291; 400/691, 692, 400/693, 693.1, 175, 208

[56] References Cited

U.S. PATENT DOCUMENTS 4,480,936 11/1984 Kasun et al. ..... 400/208
4,812,063 3/1989 Kunimitsu et al. ..... 400/234
4,938,616 7/1990 Shiozaki et al. .

FOREIGN PATENT DOCUMENTS 92886 5/1985 Japan ..... 400/693
0245574 12/1985 Japan ..... 400/208
245579 12/1985 Japan ..... 400/693.1
120780 6/1986 Japan ..... 400/691
0152769 7/1987 Japan ..... 400/208
2121359A 12/1983 United Kingdom .
2162794A 2/1986 United Kingdom .
2203701A 10/1988 United Kingdom .

OTHER PUBLICATIONS

IBM Tech. Disc. Bulletin, vol. 27, No. 6, Nov. 1984 by Kimura.

*Primary Examiner*—Edgar S. Burr
*Assistant Examiner*—Ren Yan
*Attorney, Agent, or Firm*—Frishauf, Holtz, Goodman & Woodward

[57] ABSTRACT

A printing apparatus comprises a printer body having an opening on the top side thereof, and a platen for feeding a paper sheet supported by a paper holder disposed in the printer body. The platen is provided in the body to face the opening. A head unit includes a housing having an opening on the bottom side thereof and a print head disposed in the housing to face the opening thereof. The head unit is moveable between an operative position, in which the head unit is located on the printer body so that the opening of the housing and the print head face the opening of the printer body and the platen, respectively, whereby the paper sheet between the platen and the print head is allowed to be ready for printing, and an open position in which the head unit is off the printer body so that the whole opening of the printer body is exposed.

18 Claims, 5 Drawing Sheets

PRINTING APPARATUS

BACKGROUND OF THE INVENTION

1. Field of the Invention

The present invention relates to a printing apparatus in which a platen and a print head ar opposed to each other with a paper sheet between them.

2. Description of the Related Art

In printing apparatuses of this type, a platen and a print head are arranged opposite to each other in a printer body.

The gap between the platen and the print head is so narrow that the paper sheet cannot be easily threaded between them, and cleaning these elements is troublesome. Accordingly, an apparatus (U.S. Pat. Ser. No. 07/256,766, filed Oct. 11, 1988 now U.S. Pat. No. 4,938,616, issued July 3, 1990) has been proposed in which the printer body is divided into two parts, a fixed frame and a movable frame movably supported thereon, and a platen and a thermal head are attached to the fixed and movable frames, respectively.

Even in this apparatus, however, it is difficult to secure a sufficient space for the insertion of the paper sheet between and around the platen and the thermal head. Thus, the aforementioned problems cannot be entirely settled by this arrangement.

SUMMARY OF THE INVENTION

The object of the present invention is to provide a printing apparatus in which the front of a platen can be widely exposed so that a paper sheet can be easily threaded on the front of the platen, and a print head, the platen, etc. can be easily cleaned in a wide working space, with a head unit off a printer body.

BRIEF DESCRIPTION OF THE DRAWINGS

FIGS. 1 and 2 show a printing apparatus according to a first embodiment of the present invention, in which FIG. 1 is a sectional view, and FIG. 2 is an exploded perspective view;

FIGS. 4 and 5 show a printing apparatus according to a third embodiment of the invention, in which FIG. 4 is a sectional view, and FIG. 5 is an exploded perspective view.

DETAILED DESCRIPTION OF THE PREFERRED EMBODIMENTS

Figure 1:
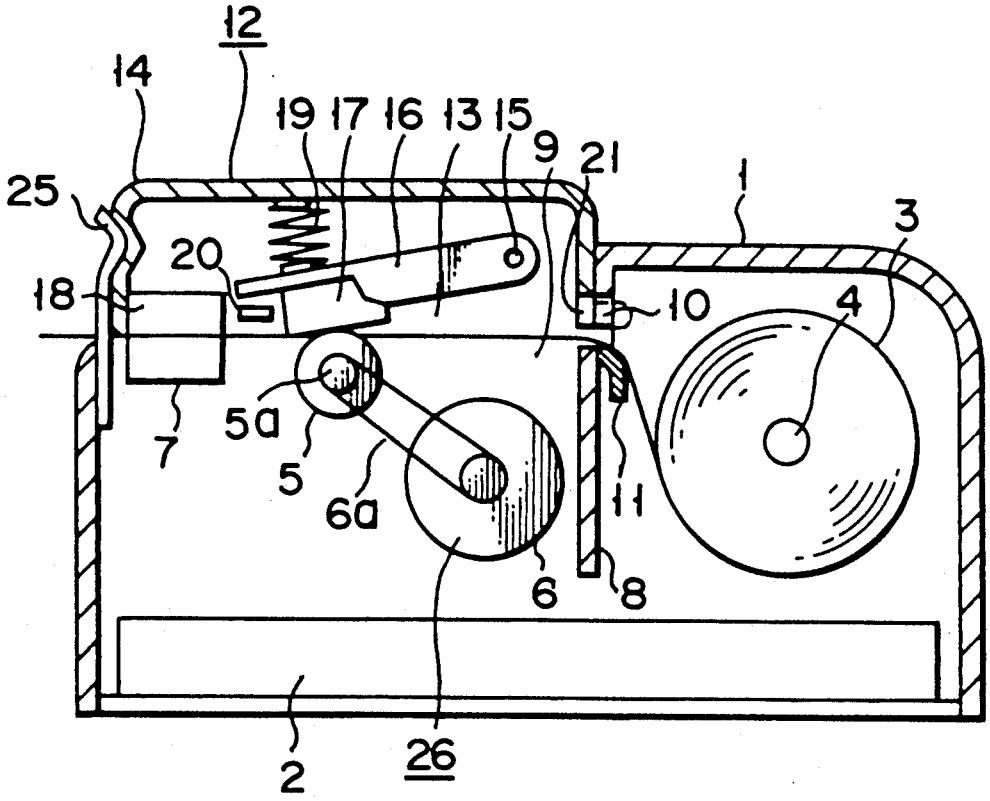
Figure 2:
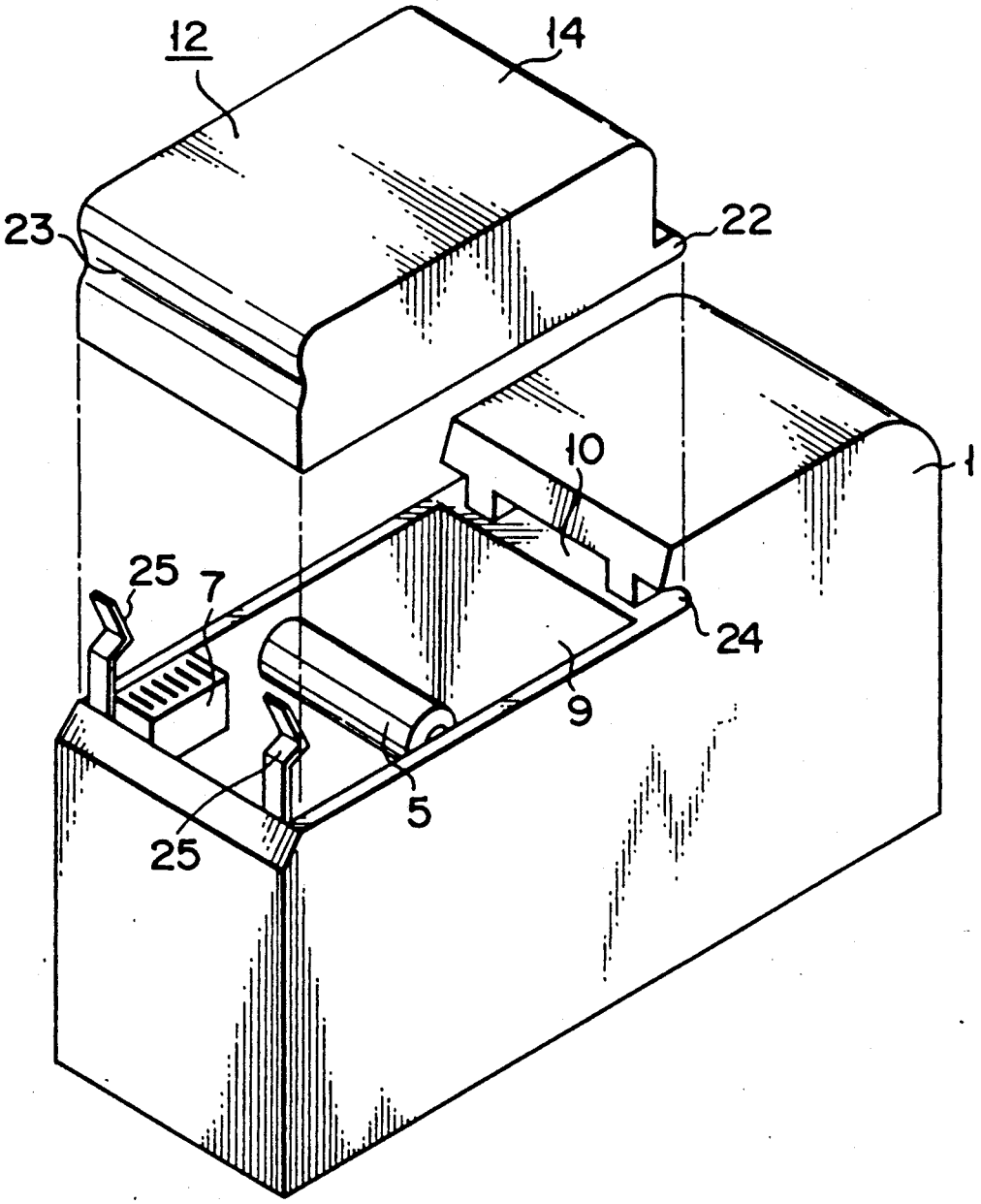

Preferred embodiments of the present invention will now be described with reference to the accompanying drawings. In these drawings, like reference numerals refer to substantially the same parts throughout the several views. In FIGS. 1 and 2, showing a printing apparatus according to a first embodiment of the invention, numeral 1 denotes a printer body, which contains control section 2 including a power supply unit, rotatable paper holder section 4 removably holding elongate paper sheet 3, rotatable platen 5, mo&:or 6, and connector 7 for use as an output section. Motor 6 has a rotating shaft which is connected with pulley 5*a* of platen 5 by means of belt 6*a*. Connector 7 is connected to control section 2. Further, printer body 1 has vertical partition wall 8 positioned between motor 6 and paper holder section 4, and opening 9 in its top face, through which platen 5 and connector 7 can be exposed or opened to the outside. Partition wall 8 is formed with through hole 10 through which sheet is passed. Guide plate 11, used to guide the sheet for its passage, is fixed to that portion of wall 8 on the side of the lower edge of hole 10.

Head unit 12 is removably mounted on printer body 1 so that opening 9 of body 1 can be opened or closed. Unit 12 includes open-bottomed head cover 14, head holder 16, thermal head 17 for use as a print head, and connector 18 for use as an input section. Cover 14 has opening 13 which faces opening 9. Holder 16 is retained for vertical rocking motion around pivot 15 supported on the proximal end of cove 14. Head 17 is fixed to the lower surface of holder 16 on the free end side thereof. Connector 18, which is connected electrically to thermal head 17, is fixed to cover 14 at a position facing connector 7. Head holder 16 is urged downward by compression spring 19 which is disposed between the free end of holder 16 and the upper wall of cover 14. Head cover 14 is provided with stopper 20 which is adapted to engage holder 16, thereby preventing the holder from excessively moving downward. Notches 21 are formed at the lower end of one side wall of cover 14 so as to connect with through hole 10.

As shown in FIG. 2, projections 22 having a semicircular end protrude outward from each of the front and rear ends of the one side wall of head cover 14. Lateral channel or recess 23 is formed on the outer surface of the other side wall of cover 14. Recesses or slots 24, which mate with projections 22, are formed on both sides of one end of opening 9 of printer body 1, that is, in partition wall 8. The respective lower ends of a pair of leaf springs 25 are fixed to the other end side of opening 9, that is, to the inner surface of the side wall of body 1. The upper or free end of each spring 25 is adapted to resiliently engage its corresponding side of channel 23, thereby preventing movement of head cover 14. Springs 25 are spaced at a distance greater than the width of paper sheet 3, across printer body 1. The slots 24, projections 22, leaf springs 25 and recess 23 comprise a fixing means for removably fixing the head unit to the printer body. Leaf spring 25 comprise fixing parts which are not removable from the printer body in use. An outlet for discharging the printed sheet is defined between the springs 25 and between the upper end of body 1 and the lower end of the cover 14. Platen 5 and motor 6, which are connected to each other, constitute sheet feeding section 26.

When head cover 14 is set on printer body 1 so as to close opening 9, in this arrangement, connectors 7 and 18 are connected electrically to each other. Paper sheet 3 is transported to the left by driving motor 6, by means of control section 2, to rotate platen 5 in the counterclockwise direction of FIG. 1. Further, sheet 3 is printed by applying a print signal from control section 2 to thermal head 17.

By detaching channel 23 of head cover 14 from leaf springs 25 and disengaging projections 22 from their corresponding recesses 24 of printer body 1, moreover, cover 14 can be removed from body 1 so that nothing overlies opening 9. Thus, there is so wide a space over platen 5 that sheet 3 can be easily threaded on the top of the platen. When head unit 12 is removed from printer body 1, furthermore, thermal head 17, platen 5, etc. can be easily cleaned in a wide working space.

In setting head cover 14 on printer body 1, projections 22 are first fitted into their corresponding recesses 24, and cover 14 is then rocked downward around the engagement points so that channel 23 on the free end side engages leaf springs 25. At the same time, connectors 7 and 18 are connected to each other.

Figure 3:
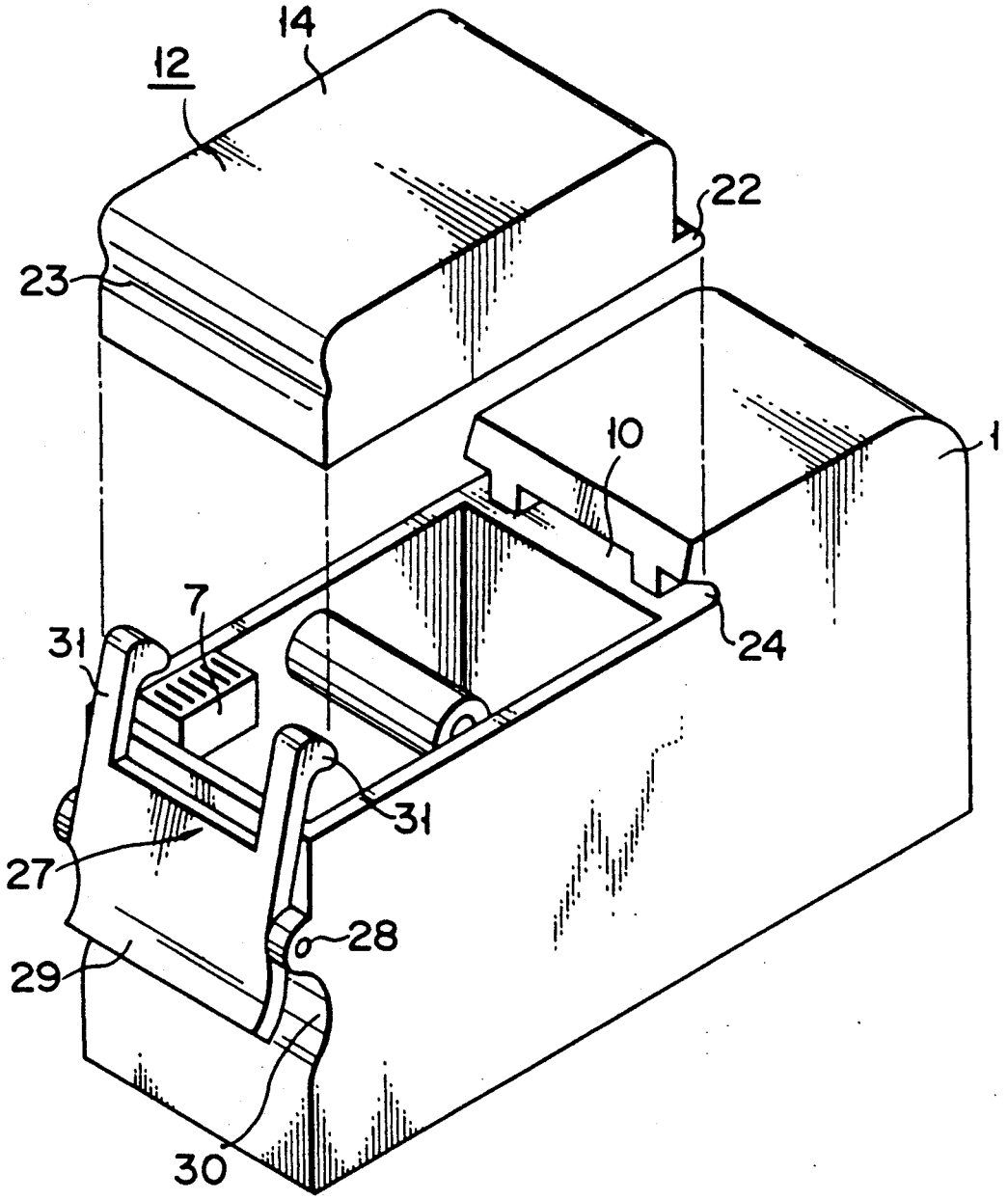
FIG. 3 is an exploded perspective view of a printing apparatus according to a second embodiment of the invention.

Referring now to FIG. 3, a printing apparatus according to a second embodiment of the present invention will be described. A pair of hinge portions 28 for rockably retaining clamp lever 27 protrude from the outer surface of one side wall of printer body 1. Also, recess 30 is formed in the outer surface of printer body 1, whereby push fin 29 at the lower part of lever 27 is freed of engagement. A pair of integral retaining claws 31 protrude individually from the opposite sides of the upper end of clamp lever 27. Claws 31 are adapted to engage the front and rear portions of channel 23 of head cover 14, individually. Lever 27 is urged to rock in the clockwise direction by means of a spring, which is disposed between the lever 27 and body 1, so that claws 31 resiliently engage channel 23 of cover 14. Engaging claws 31 are spaced apart by a distance greater than the width of paper sheet 3.

Thus, by pressing push fin 29 to rock clamp lever 27 in the counterclockwise direction, retaining claws 31 can be disengaged from channel 23 of head cover 14.

In the apparatus according to the second embodiment, the front of a platen can be made wide open to access by removing head unit 12 from printer body 1, so that a paper sheet and/or ink ribbon can be easily threaded on the front of the platen. When the head unit is removed from the printer body, moreover, a print head, the platen, etc. can be easily cleaned in a wide working space.

Figure 4:
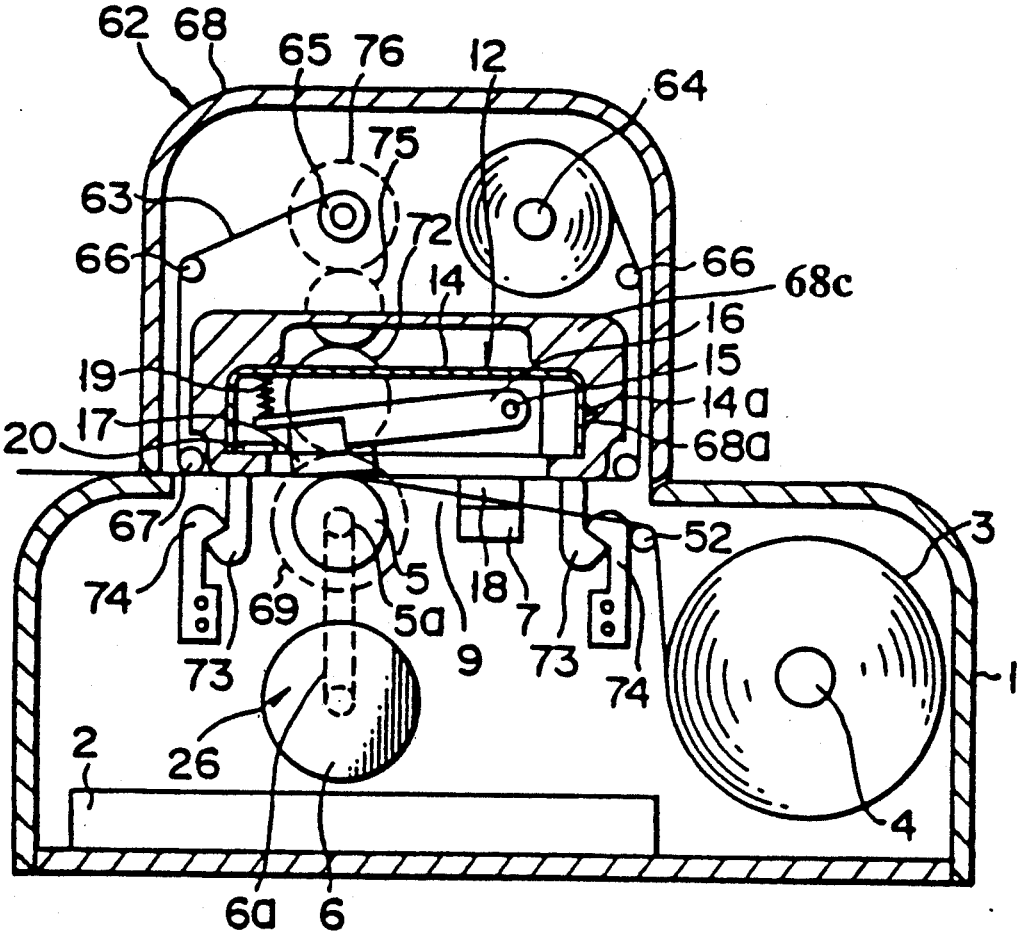
Figure 5:
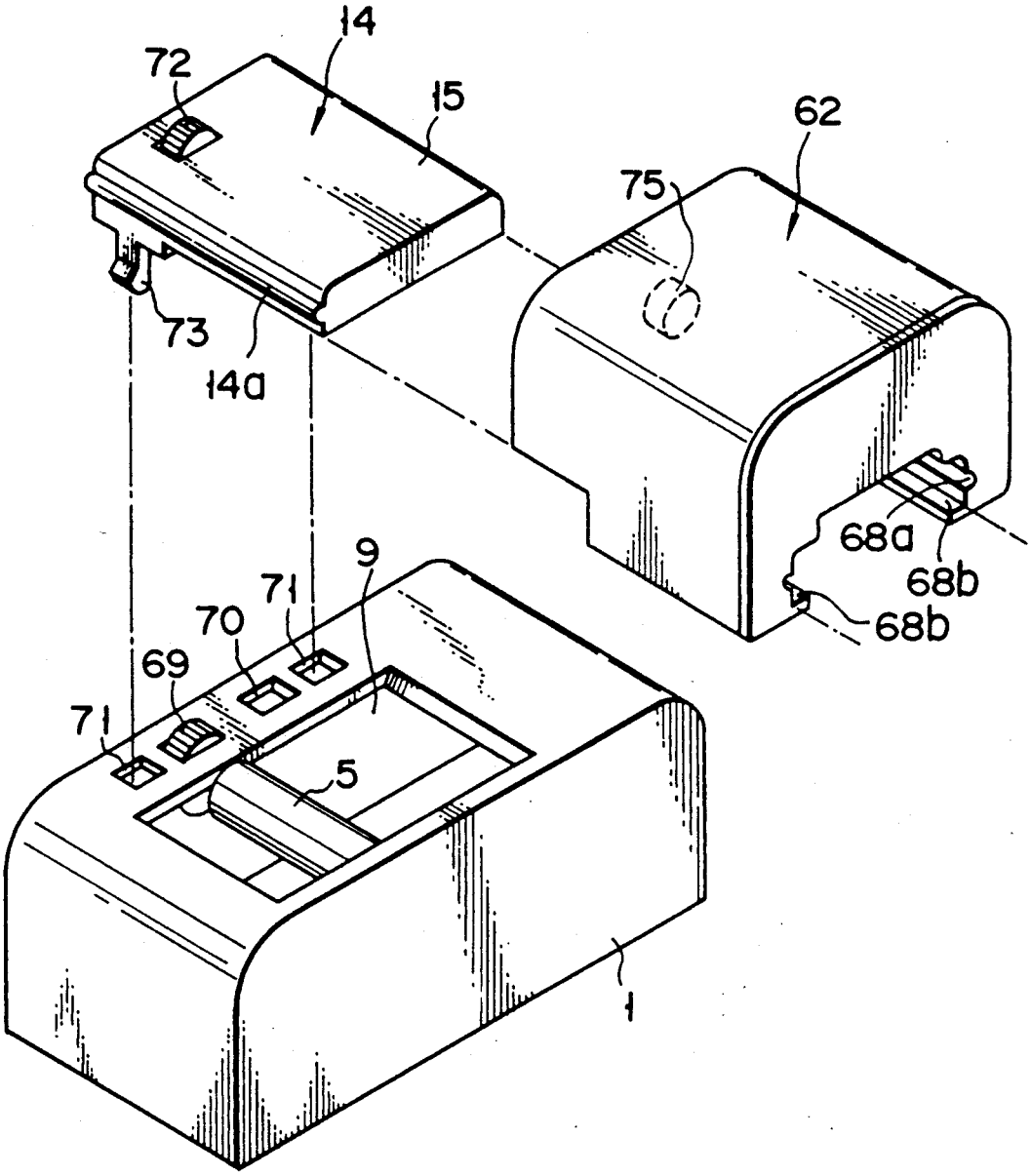

Referring now to FIGS. 4 and 5, a printing apparatus according to a third embodiment of the present invention will be described. In this case, guide roller 52 for guiding paper sheet 3 to platen 5 is rockably mounted in printer body 1.

Head unit 12, which includes head cover 14 with a U-shaped profile, is removaby mounted on the top wall of printer body 1 so that opening 9 of body 1 can be opened or closed.

Ribbon cassette 62 is removably mounted on head cover 14, which overlies opening 9 of printer body 1. The cassette includes open-bottomed cassette case 68, which is fitted with supply and take-up spindles 64 and 65, wound with ink ribbon 63, and a plurality of guide rollers 66 and 67 which define the path of ribbon 63. Cassette case 68 contains support portion **68*c* integral therewith. Support portion 68*c* has a U-shaped profile, and U-shaped fitting portion 68*b* is formed on each side of the inner periphery of portion 68*c*. Fitting portion 68*b* is adapted to be slidably fitted on each side of head cover 14. Ridge 14*a* is formed on each sliding surface of cover 14, while engaging groove 68*a* is formed on the sliding surface of each fitting portion 68*b***. Each ridge and its corresponding groove resiliently engage each other.

Referring now to FIG. 5, there will be described the relative arrangements of printer body 1, head unit 12, and ribbon cassette 62. Part of gear 69, which is coaxially connected to one end of platen 5, as one component of sheet feeding section 26, is exposed from the top face of printer body 1 through an opening. Gear 69 is situated off opening 9. Also, rectangular hole 70 for the insertion of connector 18 and two through holes 71 are formed in the top face of printer body 1. Gear 72, for use as a transmission member in mesh with gear 69, is rotatably retained by head cover 14 in a manner such that part of its outer periphery is exposed from each of the top and bottom faces of cover 14. Further, cover 14 is formed having a pair of hooks 73 which are inserted individually in holes 71. Hooks 74, which are resiliently engaged with their corresponding hooks 73, have their respective proximal or lower ends fixed to printer body 1, as shown in FIG. 4. Gear 75 is rotatably retained by support portion **68*c* of cassette case 68 in a manner such that part of its outer periphery is exposed from each of the top and bottom faces of portion 68*c*. Thus, gear 75 can be selectively engaged with gear 72. Gear 76, which is always in mesh with gear 75, is coaxially fixed to the end portion of take-up spindle 15**.

In this arrangement, no members overlie opening 9 before head unit 12 is mounted on printer body. That is, there is so wide a space over platen 5 that sheet 3 can be easily threaded on the front of the platen. In this state, moreover, thermal head 17, platen 5, etc. can be easily cleaned in a wide working space.

Head cover 14 is inserted forward or rearward into cassette case 68, sliding along fitting portions **68*b* on either side of support portion 68*c*, and engaging grooves 68*a* engage their corresponding ridges 14*a*. Thus, cover 14 and case 68 are connected to each other so that they are relatively positioned. In this state, ink ribbon 63 is guided to the underside of thermal head 17 by guide roller 67, and gears 72 and 75 are caused to engage each other. When hooks 73 are inserted into through holes 71 to be engaged with their corresponding hooks 74, connectors 7 and 18 are connected electrically to each other, and gears 69 and 72 engage each other. Paper sheet 3 is transported to the left by driving motor 6 to rotate platen 5 by means of control section 2. The rotation of the platen is transmitted to take-up spindle 65 through gears 69, 72, 75 and 76, so that ink ribbon 63 is also fed to the left. Further, sheet 3 is printed by applying a print signal from control section 2 to thermal head 17**.

Since ribbon cassette 62 is adapted to be thus mounted outside printer body 1, the printer body can be reduced in size. When using a thermosensitive paper sheet, cassette 62 is slid along the top face of printer body 1 to be removed from head cover 14. In this case, printer body 1 is small-sized, and cassette 62 need not be used, so that the whole structure can be compact.

The aforementioned apparatus has the following effects, besides those of the apparatuses of the first and second embodiments. When selectively using the ribbon cassette, the rotation of the sheet feeding section can be transmitted to the take-up spindle of the cassette by means of the transmission member if the cassette is mounted on the open face of the printer body. Since the ribbon cassette can be mounted outside the printer body, moreover, the printer body can be reduced in size. When using a thermosensitive paper sheet, therefore, the ribbon cassette can be removed to make the whole structure compact.

What is claimed is:

1. A printing apparatus comprising:

a printer body having an opening on one end side thereof;

sheet feeding means for feeding a paper sheet, said sheet feeding means being disposed in the printer body and including a platen facing the opening of the printer body, and a drive mechanism for the platen; and a head unit removably mounted on the printer body, the head unit including a housing having an opening on one end side thereof and a print head disposed in the housing to face the opening of the housing, said head unit being movable between (i) an operative position in which the head unit is mounted on the printer body so that the opening of the housing and the print head face the opening of the printer body and the platen, respectively, whereby a paper sheet is passible between the platen and the print head so as to be ready for printing, and (ii) an open position in which the head unit is completely removed from the printer body so that the whole opening of the printer body is exposed; and fixing means for removably fixing the head unit to the printer body such that the head unit is attachable to and completely removable from the printer body without removing a fixing part of the fixing means from the printer body;

said fixing means comprising:

slot means in said printer body;

projection means on said head unit for removably engaging in said slot means; and interengaging locking means on said head unit and on said printer body for locking said head unit on said printer body with said projecting means engaged in said slot means.

2. The printing apparatus according to claim 1, wherein said printer body has a top face with the opening therein, and said head unit is brought to the operative position when the head unit is mounted on the top face.

3. The printing apparatus according to claim 2, wherein:

said sheet feeding means includes a control section for controlling the drive of the platen drive mechanism, and an output section connected electrically to the control section; and said head unit includes an input section adapted to be connected electrically to the output section when the head unit is brought to the operative position for enabling a printing operation of the print head.

4. The printing apparatus according to claim 1, further comprising a ribbon cassette containing an ink ribbon therein and supporting the head unit, said ribbon cassette being mounted on one end side of the printer body, and said head unit being adapted to be brought to the operative position when the ribbon cassette is mounted on the printer body.

5. The printing apparatus according to claim 4, wherein said ribbon cassette includes a support portion including means for removably supporting the head unit and guide means for guiding the ink ribbon to the print head.

6. The printing apparatus according to claim 5, wherein said ribbon cassette includes ink ribbon drive means for driving the ink ribbon with respect to the print heads and said head unit includes a transmission mechanism for operatively connecting the ink ribbon drive means to the platen drive mechanism when the head unit is brought to the operative position by the ribbon cassette.

7. The printing apparatus according to claim 6, wherein said ink ribbon drive mechanism includes a roll rotatable so as to take up the ink ribbon, and a roll gear for rotating the roll; said platen drive mechanism includes a platen gear rotatable together with the platen; and said transmission mechanism includes gear means adapted to be in mesh with the roll gear and the platen gear.

8. The printing apparatus according to claim 7, wherein said head unit includes a cover containing therein the ink ribbon.

9. The printing apparatus according to claim 1, wherein said locking means includes a recess on one of said head unit and printer body, and recess engaging means on the other of said head unit and printer body for releasably engaging said recess to permit complete removal of said head unit from said printer body.

10. The printing apparatus according to claim 9, wherein said recess is on said head unit, and said recess engaging means is on said printer body.

11. The printing apparatus according to claim 10, wherein said recess engaging means comprises at least one resilient spring member mounted on said printer body for resiliently engaging said recess.

12. The printing apparatus to claim 11, comprising two of said resilient spring members mounted on opposite ends of said printer body for releasably and resiliently engaging said recess.

13. The printing apparatus according to claim 1, wherein said locking means comprises interengaging hook means on said head unit and on said printer body for locking said head unit on said printer body.

14. The printing apparatus according to claim 10, wherein said engaging means on said printer body comprises at least one claw pivotally mounted on said printer body for engaging said recess.

15. The printing apparatus according to claim 14, wherein said engaging means comprises spring means for resiliently biasing said claw toward said recess for resiliently engaging said recess.

16. The printing apparatus to claim 15, comprising two of said claws mounted on opposite ends of said printer body for releasably and resiliently engaging said recess.

17. A printing apparatus comprising:

a printer body having an opening on one end side thereof;

sheet feeding means for feeding a paper sheet, said sheet feeding means being disposed in said printer body and including a platen facing the opening of said printer body, and a drive mechanism for the platen;

a head unit removably mounted on said printer body, said head unit including a housing having an opening on one end side thereof and a print head disposed in the housing to face the opening of said housing, said head unit being movable between an operative position in which said head unit is mounted on said printer body so that the opening of said housing and said print head face the opening of said printer body and the platen, respectively, whereby a paper sheet is disposed between the platen and said print head so as to be ready for printing, and an open position in which said head unit is completely removed from said printer body so that the whole opening of said printer body is exposed;

said printer body and said head unit each having front and rear side walls, respectively;

mounting means disposed on each of said side walls for removably mounting said head unit to said printer body such that said head unit is attachable to and completely removable from said printer body;

said mounting means comprising resilient leaf springs and a channel to receive said leaf springs at said front side walls and recesses and projections at said rear side walls, said projections being received in said recesses prior to said leaf spring being received in said channel.

18. A printing apparatus comprising:

a printer body having an opening on one end side thereof;

sheet feeding means for feeding a paper sheet, said sheet feeding means being disposed in said printer body and including a platen facing the opening of said printer body, and a drive mechanism for the platen;

a ribbon cassette and a head unit, said ribbon cassette having engaging grooves and said head unit having ridges, said ridges being slidably received in said engaging grooves to mount said head unit in said ribbon cassette, said ribbon cassette containing said head unit being removably mounted on said printer body;

said head unit including a housing having an opening on one end side thereof and a print head disposed in said housing to face the opening of said housing, said head unit being movable between an operative position in which said head unit is mounted on said printer body so that the opening of said housing and said print head face the opening of said printer body and the platen, respectively, whereby a paper sheet disposed between the platen and said print head is ready for printing, and an open position in which said head unit is completely removed from said printer body so that the whole opening of said printer body is exposed; and mounting means comprising at least one pair of interlocking hook means disposed in each of said printer body and said head unit, said hook means of said printer body engaging said hook means of said head unit for releasably locking said head unit together with said ribbon cassette on said printer body.

* * * * *